US010000835B2

(12) United States Patent
Kubota et al.

(10) Patent No.: US 10,000,835 B2
(45) Date of Patent: Jun. 19, 2018

(54) COOLING METHOD AND COOLING DEVICE FOR AL ALLOY MANUFACTURED CASTING

(71) Applicant: MAZDA MOTOR CORPORATION, Hiroshima (JP)

(72) Inventors: Tomohide Kubota, Higashi-Hiroshima (JP); Naoaki Yamamoto, Higashi-Hiroshima (JP); Shuichi Hashimoto, Aki-gun (JP); Yasuyuki Misawa, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 590 days.

(21) Appl. No.: 14/426,961

(22) PCT Filed: Mar. 14, 2013

(86) PCT No.: PCT/JP2013/001708
§ 371 (c)(1),
(2) Date: Mar. 9, 2015

(87) PCT Pub. No.: WO2014/045475
PCT Pub. Date: Mar. 27, 2014

(65) Prior Publication Data

US 2015/0211099 A1 Jul. 30, 2015

(30) Foreign Application Priority Data

Sep. 18, 2012 (JP) ..... 2012-203930

(51) Int. Cl.
*B22D 21/00* (2006.01)
*C22C 21/00* (2006.01)
(Continued)

(52) U.S. Cl.
CPC ..... *C22F 1/002* (2013.01); *B22D 17/20* (2013.01); *B22D 21/007* (2013.01); *B22D 21/04* (2013.01);
(Continued)

(58) Field of Classification Search
CPC ..... C22F 1/002; C22F 1/04; B22D 30/00
(Continued)

(56) References Cited

U.S. PATENT DOCUMENTS 6,224,693 B1 5/2001 Garza-Ondarza et al.
2001/0009170 A1 7/2001 Garza-Ondarza et al.
(Continued)

FOREIGN PATENT DOCUMENTS

CN 1833796 A 9/2006
CN 101020965 A 8/2007
(Continued)

OTHER PUBLICATIONS

International Search Report; PCT/JP2013/001708; dated Apr. 16, 2013.

*Primary Examiner* — Scott Kastler
(74) *Attorney, Agent, or Firm* — Studebaker & Brackett PC

(57) ABSTRACT

A method includes product side showering of showering a first surface (the surface of a product (11) opposite to a feeder head (12)) of an Al alloy casting (10) including the product (11) and the feeder head (12) with mist of cooling liquid, and feeder head side showering of showering a second surface (the surface of the feeder head (12) opposite to the product (11)) of the Al alloy casting (10) with the mist of the cooling liquid. The feeder head side showering starts showering the second surface of the Al alloy casting (10)
(Continued)

after a start and before an end of the product side showering to quench and cool the Al alloy casting (10) together with the product side showering.

7 Claims, 10 Drawing Sheets

(51) Int. Cl.

| | |
|---|---|
| ***C22F 1/00*** | (2006.01) |
| ***B22D 21/04*** | (2006.01) |
| ***B22D 30/00*** | (2006.01) |
| ***B22D 17/20*** | (2006.01) |
| ***C22F 1/04*** | (2006.01) |

(52) U.S. Cl.
CPC ..... *B22D 30/00* (2013.01); *C22C 21/00* (2013.01); *C22F 1/04* (2013.01)

(58) Field of Classification Search
USPC ..... 148/156
See application file for complete search history.

(56) References Cited

U.S. PATENT DOCUMENTS

| | | | | |
|---|---|---|---|---|
| 2005/0103407 | A1 | 5/2005 | Masuda et al. | |
| 2007/0051336 | A1 | 3/2007 | Barth et al. | |
| 2010/0292966 | A1 | 11/2010 | Wang et al. | |
| 2015/0211099 | A1* | 7/2015 | Kubota ..... | B22D 21/04 148/549 |

FOREIGN PATENT DOCUMENTS

| | | | |
|---|---|---|---|
| CN | 102634744 | A | 8/2012 |
| DE | 103 03 980 | B3 | 4/2004 |
| DE | 103 22 309 | A1 | 12/2004 |
| DE | 10 2010 019 733 | A1 | 1/2011 |
| JP | S60-170567 | A | 9/1985 |
| JP | H07-116824 | A | 5/1995 |
| JP | H08-225903 | A | 9/1996 |
| JP | 2003-230953 | A | 8/2003 |
| JP | 2004-515655 | A | 5/2004 |
| JP | 2005-169498 | A | 6/2005 |
| WO | 02/48419 | A2 | 6/2002 |

* cited by examiner

COOLING METHOD AND COOLING DEVICE FOR AL ALLOY MANUFACTURED CASTING

TECHNICAL FIELD

The present invention relates to a method of cooling an Al alloy casting formed by injecting a molten Al alloy into a cavity and a feeder head cavity formed in a mold, and a device for cooling such an Al alloy casting.

BACKGROUND ART

In general, an Al alloy casting is formed in a mold including a cavity and a feeder head cavity. Thus, the formed Al alloy casting includes a product corresponding to the cavity and a feeder head corresponding to the feeder head cavity. The feeder head is eventually cut off from the product. For example, a cylinder head, cylinder blocks, etc., of an engine are casted as the product.

The formed Al alloy casting (i.e., the product and the feeder head) is subjected to quenching (solution quenching) and aging in this order to increase the mechanical strength.

In view of facility, conventional quenching is performed by putting (sinking) the Al alloy casting formed in the mold into stored water.

The quenched and cooled Al alloy casting is placed in a furnace whose temperature is maintained higher than the temperature of the Al alloy casting, thereby aging the Al alloy casting. This requires futile work of heating the quenched and cooled Al alloy casting. There is thus a need to simplify the process of the aging.

PATENT DOCUMENT 1 discloses a method of quenching an Al alloy casting including a feeder head and a product to artificially age the Al alloy casting. The product of the Al alloy casting is selectively quenched and cooled (where the product is the cylinder head of an engine, the surface of the cylinder head at the combustion chamber is quenched and cooled by water spray). On the other hand, the feeder head is maintained at a relatively high temperature. When the product is cooled to a temperature range for artificial aging or a lower temperature, the quenching is interrupted to artificially age the product with the residual heat flowing from the relatively hot feeder head.

PATENT DOCUMENT 2 discloses the following. After casting in a mold including a sand mold forming a feeder head cavity, and a metal mold forming part of a cavity, the metal mold is separated. The surface of the casting (where the product is the cylinder head of an engine, the surface of the cylinder head at the combustion chamber) exposed by the separation touches a cooling medium to quench the casting. Then, the casting is covered by the sand mold and a heat insulating material to age the entire casting with the potential heat of the feeder head.

CITATION LIST

Patent Document

[PATENT DOCUMENT 1] Japanese Translation of PCT International Application No. 2004-515655

[PATENT DOCUMENT 2] Japanese Unexamined Patent Publication No. 2005-169498

SUMMARY OF THE INVENTION

Technical Problem

In PATENT DOCUMENTS 1 and 2, where the cylinder head of an engine is casted in the cavity of the mold, only the surface of the cylinder head at the combustion chamber (the side opposite to the feeder head) touches the cooling medium. This tends to deform the cylinder head, since it has a three-dimensional structure. Then, there are differences in the size among the portions of the cylinder head corresponding to a plurality of cylinders. The strength of the whole cylinder head tends to vary.

The present invention was made from this point of view. The present invention assumes that an Al alloy casting is formed in a mold, and then quenched and cooled. The present invention aims to reduce variations in the strength of the whole product of the Al alloy casting as much as possible, to reduce differences in the size among a plurality of portions of the product, which need to have the same size, as much as possible, and to facilitate the aging of the Al alloy casting.

Solution to the Problem

In order to achieve the objectives, the present invention provides a method of cooling an Al alloy casting formed by injecting a molten Al alloy into a cavity and a feeder head cavity formed in a mold, and including a product corresponding to the cavity and a feeder head corresponding to the feeder head cavity. The mold includes a mold body including a first space for the cavity, a second space for the feeder head cavity, a first open portion configured to expose the first space toward a side opposite to the second space, and a second open portion configured to expose the second space toward a side opposite to the first space; a first closing member configured to close the first open portion of the mold body to form the cavity together with the mold body; and a second closing member configured to close the second open portion of the mold body to form the feeder head cavity together with the mold body. The method includes, after forming the Al alloy casting in the mold, separating the first closing member of the mold from the mold body to expose a first surface of the Al alloy casting being a surface of the product opposite to the feeder head through the first open portion of the mold body; product side showering of showering the first surface of the Al alloy casting exposed in the separating the first closing member with mist of cooling liquid through a product side nozzle facing the first surface to quench and cool the Al alloy casting; after a start of the product side showering, separating the second closing member of the mold from the mold body to expose a second surface of the Al alloy being a surface of the feeder head opposite to the product through the second open portion of the mold body; and feeder head side showering of showering the second surface of the Al alloy casting exposed in the separating the second closing member with mist of cooling liquid through a feeder head side nozzle facing the second surface. The feeder head side showering starts showering the second surface of the Al alloy casting after the start and before an end of the product side showering to quench and cool the Al alloy casting together with the product side showering.

In the cooling method, the first surface (the surface of the product opposite to the feeder head) of the Al alloy casting is showered first with the mist of the cooling liquid, thereby cooling the product from the surface opposite to the feeder head toward the feeder head side. At this time, the entire first surface of the Al alloy casting is uniformly showered with the mist of the cooling liquid. On the other hand, the feeder head side of the product is less likely to be cooled than the side of the product opposite to the feeder head due to the heat of the feeder head. As a result, the temperature of the product hardly becomes uniform between the feeder head side and the side opposite to the feeder head. However, in this cooling method, the second surface (the surface of the feeder head opposite to the product) of the Al alloy casting is also showered with the mist of the cooling liquid. The feeder head side of the product is thus greatly cooled via the feeder head. Thus, variations in the strength of the whole product of the Al alloy casting are reduced and the product is less deformed, thereby reducing differences in the size among a plurality of portions of the product, which need to have the same size. In addition, since the feeder head side showering starts after the start and before the end of the product side showering, the temperature of the surface of the product at the feeder head is higher than the temperature of the surface of the product opposite to the feeder head by a predetermined temperature at the end of the product side showering and the feeder head side showering. Accordingly, the Al alloy casting is aged utilizing the residual heat of the feeder head or the feeder head side of the product. There is thus no need to heat the quenched and cooled Al alloy casting in a furnace, etc., to age the Al alloy. The Al alloy casting is thus readily aged.

The method of cooling the Al alloy casting preferably further includes, after the end of the product side showering and the feeder head side showering, aging the Al alloy casting with residual heat of the Al alloy casting with the second open portion of the mold body closed again by the second closing member of the mold.

The quenched and cooled Al alloy casting is thus readily aged. Specifically, at the end of the product side showering and the feeder head side showering, the temperature of the surface of the product at the feeder head is set higher than the temperature of the surface of the product opposite to the feeder head by a predetermined temperature. Since the second open portion of the mold body is closed again, the residual heat at the feeder head or the feeder head side of the product is not released outside the mold body, and greatly conducted to the product at the side opposite to the feeder head. As a result, the temperature of the product at the side opposite to the feeder head rises so that the temperature of the whole Al alloy casting (particularly, the whole product) becomes substantially uniform. In this state, the whole Al alloy casting (the whole product) is substantially uniformly aged. Therefore, the Al alloy casting is readily and properly aged with the residual heat of the Al alloy casting (particularly, the residual heat at the feeder head or the feeder head side of the product). This results in further reduction in the variations in the strength of the whole aged product of the Al alloy casting, and further reduction in the differences in the size among the plurality of portions which need to have the same size.

In the method of cooling the Al alloy casting, the product side nozzle preferably includes a plurality of product side nozzles. The feeder head side nozzle preferably includes a plurality of feeder head side nozzles. The product side showering preferably showers the first surface of the Al alloy casting with the mist of the cooling liquid through the product side nozzles while controlling pressure of air and the cooling liquid supplied to the product side nozzles. The feeder head side showering preferably showers the second surface of the Al alloy casting with the mist of the cooling liquid through the feeder head side nozzles, while controlling pressure of air and the cooling liquid supplied to the feeder head side nozzles.

With this feature, the entire first surface and the entire second surface of the Al alloy casting is more uniformly showered with the mist of the cooling liquid through the plurality of product side nozzles and the plurality of the feeder head side nozzles. In addition, the pressure of the air and the cooling liquid supplied to the product side nozzles and the feeder head side nozzles is controlled. This suitably showers the portions of the first surface of the Al alloy casting corresponding to the product side nozzles, and the portions of the second surface of the Al alloy casting corresponding to the feeder head side nozzles with the mist of the cooling liquid. The cooling is precisely controlled in each portion of the Al alloy casting.

As described above, where the pressure of the air and the cooling liquid supplied to the product side nozzles and the feeder head side nozzles is controlled, each of the first and second surfaces of the Al alloy casting is preferably in a substantially rectangular shape. The plurality of product side nozzles are preferably arranged at intervals along a width of the first surface of the Al alloy casting in at least three product side nozzle rows extending along a length of the first surface. The plurality of feeder head side nozzles are preferably arranged at intervals along a width of the second surface of the Al alloy casting in at least three feeder head side nozzle rows extending along a length of the second surface. As compared to pressure of the cooling liquid supplied to the product side nozzles in end ones of the at least three product side nozzle rows, pressure of the cooling liquid supplied to the product side nozzles in the other product side nozzle row(s) is preferably set high.

Accordingly, the product of the Al alloy casting is in a substantially cuboid shape. A widthwise intermediate portion of the product is less likely to be cooled than the both widthwise ends, which are in contact with the mold. Utilizing the above-described relation of the pressure of the cooling liquid, more cooling liquid is showered on the widthwise intermediate portion of the product of the Al alloy casting than on the both widthwise ends. As a result, the whole product of the Al alloy casting is more uniformly cooled.

In the method of cooling the Al alloy casting, a particle size of the mist of the cooling liquid supplied from the product side nozzle and the feeder head side nozzle preferably ranges from 30 μm to 50 μm, both inclusive.

Specifically, where the particle size of the mist of the cooling liquid is smaller than 30 nm, the mist of the cooling liquid is likely to be vaporized in the air. The mist of the cooling liquid may be vaporized before touching the first surface or the second surface of the Al alloy casting. On the other hand, where the particle size is greater than 50 nm, it may take a long time to vaporize the mist of the cooling water after touching the first surface or the second surface of the Al alloy casting. Thus, the particle size falls within the range from 30 nm to 50 nm, thereby allowing the mist of the cooling water to touch the first surface or the second surface of the Al alloy casting and vaporizing the mist of the cooling water immediately after the touch. As a result, the Al alloy casting is efficiently cooled. The particle size of the mist of the cooling water coming out of the product side nozzles is readily controlled by controlling the pressure of the air and the cooling water supplied to the product side nozzles. Similarly, the particle size of the mist of the cooling water coming out of the feeder head side nozzles is readily controlled by controlling pressure of the air and the cooling water supplied to the feeder head side nozzles.

In the method of cooling the Al alloy casting, the product side showering, the separating the second closing member, and the feeder head side showering are preferably performed in a shower room.

This feature prevents the vapor produced by vaporizing the cooling liquid from spreading outside the shower room. In particular, where the plurality of Al alloy castings are quenched and cooled at the same time, the plurality of Al alloy castings are subjected to the product side showering and the feeder head side showering in respective shower rooms. This prevents each Al alloy casting from being influenced by the spread of the vapor from the other Al alloy castings. In addition, since the second closing member is separated in the shower room, there is no need to put the Al alloy casting in and out of the shower room between the product side showering and the feeder head side showering. The product side showering, separating the second closing member, and the feeder head side showering are performed in series.

In the method of cooling the Al alloy casting, the product of the Al alloy casting is preferably a cylinder head of an engine. The first surface of the Al alloy casting is preferably a surface of the cylinder head at a combustion chamber.

As a result, the cylinder head of the engine is accurately manufactured with uniform and great strength as a whole. In particular, the cylinder is preferably used for an engine with a high compression ratio. This reduces variations in the strength and differences in the size among portions of the cylinder head, which correspond to a plurality of cylinders and need to have a same size. Then, an excellent engine with less vibrations and stabilized output is obtained.

Another aspect of the present invention provides a device for cooling an Al alloy casting formed by injecting a molten Al alloy into a cavity and a feeder head cavity formed in a mold, and including a product corresponding to the cavity and a feeder head corresponding to the feeder head cavity. The mold includes a mold body including a first space for the cavity, a second space for the feeder head cavity, a first open portion configured to expose the first space toward a side opposite to the second space, and a second open portion configured to expose the second space toward a side opposite to the first space; a first closing member configured to close the first open portion of the mold body to form the cavity together with the mold body; and a second closing member configured to close the second open portion of the mold body to form the feeder head cavity together with the mold body. The device includes a first closing member separator configured to separate the first closing member of the mold from the mold body after forming the Al alloy casting in the mold to expose a first surface of the Al alloy casting being a surface of the product opposite to the feeder head through the first open portion of the mold body; a product side shower configured to shower the first surface of the Al alloy casting exposed by separation of the first closing member by the first closing member separator with mist of cooling liquid through a product side nozzle facing the first surface to quench and cool the Al alloy casting; a second closing member separator configured to separate the second closing member of the mold from the mold body after a start of the showering of the first surface of the Al alloy casting using the product side shower to expose a second surface of the Al alloy being a surface of the feeder head opposite to the product through the second open portion of the mold body; and a feeder head side shower configured to shower the second surface of the Al alloy casting exposed by separation of the second closing member using the second closing member separator with mist of cooling liquid through a feeder head side nozzle facing the second surface. The feeder head side shower starts showering the second surface of the Al alloy casting after the start and before an end of the showering of the first surface of the Al alloy casting using the product side shower to quench and cool the Al alloy casting together with the product side shower.

Similar to the method of cooling the Al alloy casting, this structure reduces variations in the strength of the whole product of the Al alloy casting, and reduces differences in the size among a plurality of portions of the product, which need to have the same size. In addition, the Al alloy casting is readily aged.

In the device for cooling the Al alloy casting, the second closing member separator preferably allows the second closing member separated from the mold body to close the second open portion of the mold body again. The device for cooling the Al alloy casting preferably allows the second closing member to close the second open portion of the mold body again using the second closing member separator after the end of the showering of the first surface of the Al alloy casting by the product side shower and showering the second surface of the Al alloy casting by the feeder head side shower to age the Al alloy casting with residual heat of the Al alloy casting.

This feature readily ages the quenched and cooled Al alloy casting. In addition, variations in the strength of the whole aged product of the Al alloy casting are further reduced. Differences in the size among a plurality of portions of the product, which need to have the same size, are also further reduced.

In the device for cooling the Al alloy casting, the product side nozzle preferably includes a plurality of product side nozzles. The feeder head side nozzle preferably includes a plurality of feeder head side nozzles. The product side shower preferably includes a product side supplier configured to supply air and cooling liquid to the product side nozzles, while controlling pressure of the air and the cooling liquid. The feeder head side shower preferably includes a feeder head side supplier configured to supply air and the cooling liquid to the feeder head side nozzles, while controlling pressure of the air and the cooling liquid.

Accordingly, cooling is precisely controlled in each portion of the Al alloy casting.

As described above, where the product side shower includes the product side supplier, and the feeder head side shower includes the feeder head side supplier, each of the first and second surfaces of the Al alloy casting is preferably in a substantially rectangular shape. The plurality of product side nozzles are preferably arranged at intervals along a width of the first surface of the Al alloy casting in at least three product side nozzle rows extending along a length of the first surface. The plurality of feeder head side nozzles are preferably arranged at intervals along a width of the second surface of the Al alloy casting in at least three feeder head side nozzle rows extending along a length of the second surface. The product side supplier preferably sets, as compared to pressure of the cooling liquid supplied to the product side nozzles in end ones of the at least three product side nozzle rows, pressure of the cooling liquid supplied to the product side nozzles in the other product side nozzle row(s) high.

The entire product of the Al alloy casting is more uniformly cooled.

Advantages of the Invention

As described above, a method of cooling an Al alloy casting and a device for cooling an Al alloy casting according to the present invention reduces variations in the strength of the whole product of the Al alloy casting, less deforms the product to reduce differences in the size among a plurality of portions of the product, which need to have the same size. In addition, the Al alloy casting is readily aged.

BRIEF DESCRIPTION OF THE DRAWINGS

FIG. 6 is a bottom view of the mold, which is placed on a setting base in the shower room and in which the first closing member is separated from the mold body.

FIG. 7 is a top view of the mold, which is placed on the setting base in the shower room and in which the second closing member is separated from the mold body.

DESCRIPTION OF EMBODIMENTS

An embodiment of the present invention will be described hereinafter in detail with reference to the drawings.

Figure 1:
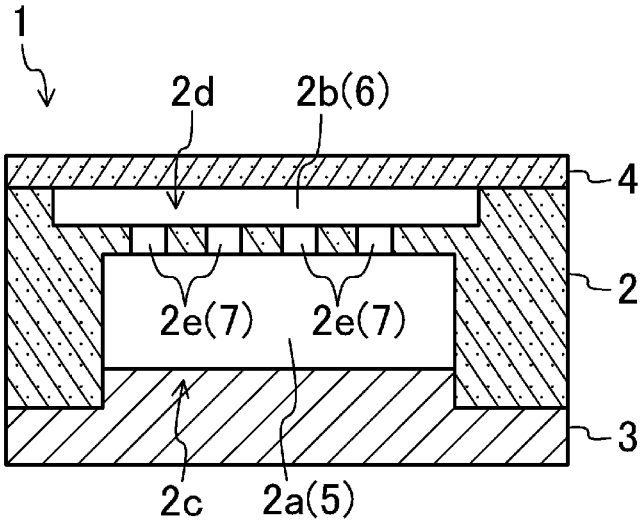
FIG. 1 is a cross-sectional view schematically illustrating a mold for forming an Al alloy casting.

FIG. 1 illustrates a mold 1 for forming an Al alloy casting. In this mold 1, a cavity 5 and a feeder head cavity 6 are arranged vertically. The mold 1 includes a mold body 2, a first closing member 3, and a second closing member 4, which are separable from each other.

The mold body 2 includes a first space 2*a* for the cavity 5, a second space 2*b* for the feeder head cavity 6, a first open portion 2*c*, a second open portion second 2*d*, and a plurality of communication portions 2*e*. The first open portion 2*c* exposes the first space 2*a* toward the opposite side of the second space 2*b*. The second open portion exposes the second space 2*b* toward the opposite side of the first space 2*a*. The plurality of communication portions 2*e* allow the first space 2*a* to communicate with the second space 2*b*. The plurality of communication portions 2*e* form a molten metal supply passage 7, which supplies a molten Al alloy 9 (see FIGS. 2 and 3) from the feeder head cavity 6 to the cavity 5.

The first closing member 3 closes the first open portion 2*c* of the mold body 2, thereby forming the cavity 5 together with the mold body 2. The second closing member 4 closes the second open portion 2*d* of the mold body 2, thereby forming the feeder head cavity 6 together with the mold body 2.

Figure 4:
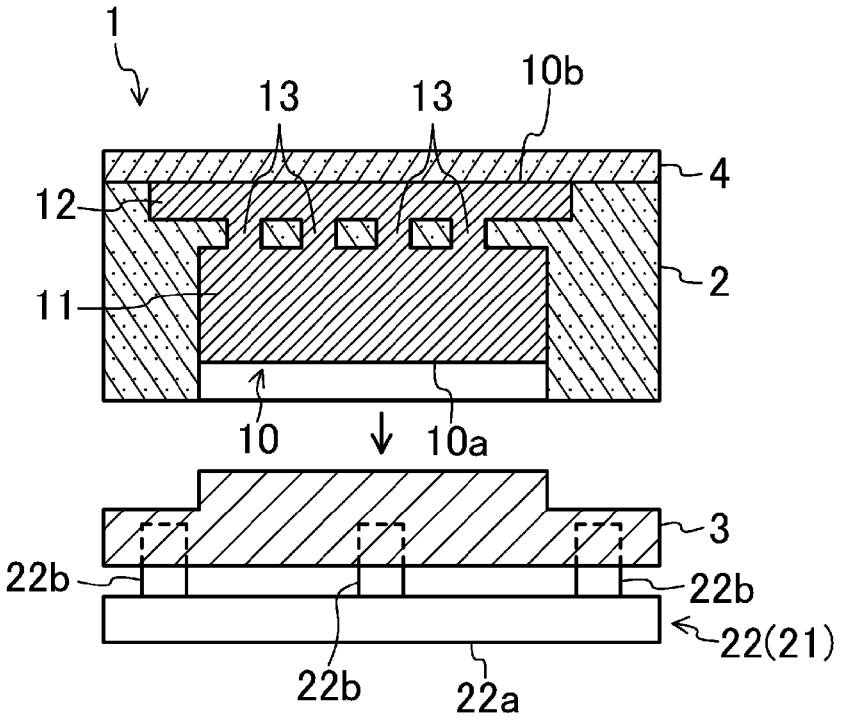
FIG. 4 is a schematic view illustrating separation of a first closing member of the mold from a mold body using a first closing member separator.

The molten Al alloy 9 is injected into the cavity 5 and the feeder head cavity 6 in the mold 1 to form an Al alloy casting 10 (see FIG. 4). This Al alloy casting 10 includes a product 11 corresponding to the cavity 5, a feeder head 12 corresponding to the feeder head cavity 6, and connecting portions 13 corresponding to the molten metal supply passage 7. As will be described later, the feeder head 12 and the connecting portions 13 are cut off from the product 11. Eventually, the desired product 11 is obtained. FIG. 1 schematically illustrates the entire mold 1 including the cavity 5, the feeder head cavity 6, and the molten metal supply passage 7. Detailed shapes are not shown. Accordingly, FIG. 4, etc., schematically illustrates the Al alloy casting 10.

In this embodiment, the above-described product 11 is a cylinder head for an inline-four engine and is in a substantially cuboid shape. The feeder head 12 is also in a substantially cuboid shape. While the product 11 and the feeder head 12 are connected by the above-described connecting portions 13, the Al alloy casting 10 is as a whole in a substantially cuboid shape. The horizontal direction of FIG. 1 is the longitudinal direction of the product 11 (i.e., the cylinder head) corresponding to a cylinder row direction.

Figure 6:
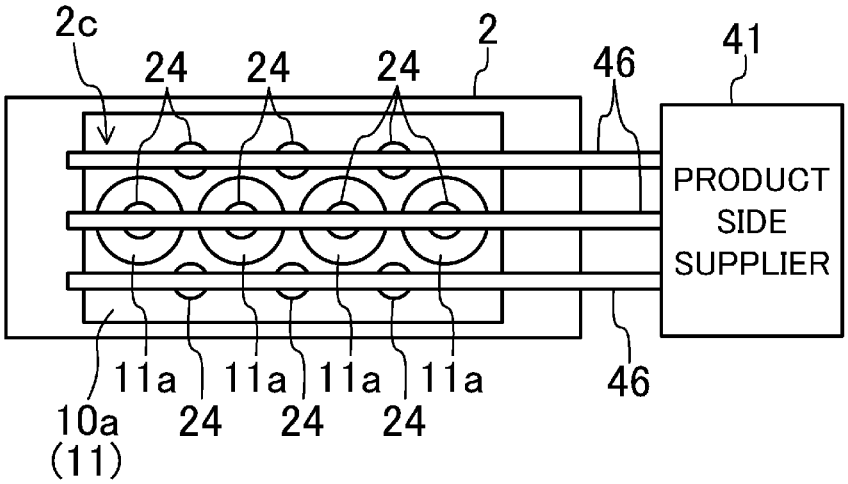
FIG. 6 illustrates a product side shower.

In this embodiment, the mold body 2 and the second closing member 4 of the above-described mold 1 are formed by a sand mold, and the first closing member 3 is formed by a metal mold. The first closing member 3 formed by the metal mold forms the surface of the product 11 opposite to the feeder head 12. In this embodiment, the surface of the product 11 opposite to the feeder head 12 is the surface of the cylinder head at the combustion chamber. The surface of the product 11 at the feeder head 12 is the surface of the cylinder head at the head cover. Hereinafter, the surface of the product 11 of the Al alloy casting 10 opposite to the feeder head 12 is referred to as a first surface 10*a* of the Al alloy casting 10. The surface of the feeder head 12 of the Al alloy casting 10 opposite to the product 11 is referred to as a second surface 10*b* of the Al alloy casting 10. In this embodiment, each of the first surface 10*a* and the second surface 10*b* of the Al alloy casting 10 is in a substantially rectangular shape. The first surface 10*a* of the Al alloy casting 10 has four recesses 11*a*, which are shown in FIG. 6 only. The four recesses 11*a* are ceilings of the combustion chambers formed in the respective four cylinders of the above-described engine.

Figure 2:
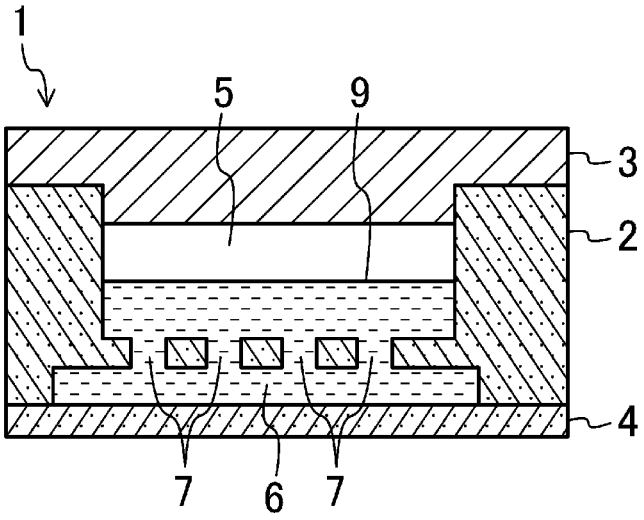
FIG. 2 is a schematic view illustrating injection of a molten Al alloy into a feeder head cavity or a cavity in the mold.

In order to produce the above-described Al alloy casting 10, first, as shown in FIG. 2, the mold 1 is placed such that the first closing member 3 is located above the mold body 2, and the second closing member 4 is located under the mold body 2. The molten Al alloy 9 is injected into the feeder head cavity 6 from a gate (not shown), which communicates with the feeder head cavity 6. The molten Al alloy 9 passes from the feeder head cavity 6 through the molten metal supply passage 7 to be injected into the cavity 5 above the feeder head cavity 6. If the feeder head cavity 6 is located above the cavity 5, the molten Al alloy 9 drops from the feeder head cavity 6 to the cavity 5, thereby making the flow of the molten Al alloy 9 turbulent to take the air. However, as described above, the molten Al alloy 9 is supplied from the lower feeder head cavity 6 to the upper cavity 5, thereby making the flow of the molten Al alloy 9 laminar to prevent the air from being taken in.

Figure 3:
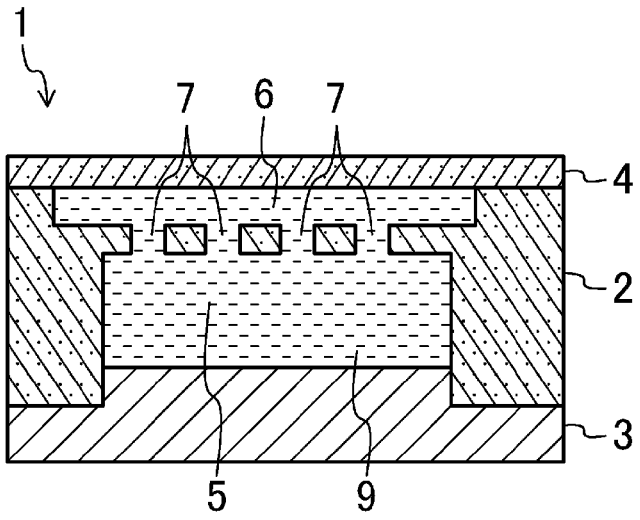
FIG. 3 is a schematic view illustrating solidification of the molten Al alloy, which has been injected into the feeder head cavity or the cavity in the mold.

When the injection of the molten Al alloy 9 into the cavity 5 is complete, as shown in FIG. 3, the mold 1 is inverted such that the second closing member 4 is located above the mold body 2 and the first closing member 3 is located under the mold body 2. In this state, the mold is left to solidify the molten Al alloy 9. The volume of the molten Al alloy 9 in the cavity 5 decreases due to the solidification, thereby naturally supplying to the cavity 5, the molten Al alloy 9 in the feeder head cavity 6 above the cavity 5. Then, the molten Al alloy 9 is solidified to complete the Al alloy casting 10.

The Al alloy casting 10, which has been formed in this manner, is after the casting, quenched and cooled using a cooling device (cooler) 21 (see FIGS. 4 and 5) as will be described later. After the quenching and cooling, aging is performed. The cooling device (cooler) 21 includes a first closing member separator 22 (see FIG. 4). After the casting of the Al alloy casting 10, the first closing member separator 22 separates the first closing member 3 of the mold 1 from the mold body 2 to expose the first surface 10*a* of the Al alloy casting 10 through the first open portion 2*c* of the mold body 2. The first closing member separator 22 includes a moving member 22*a* and holding members 22*b*. The moving member 22*a* is driven by a driving device (not shown) to vertically move to and away from the mold 1. The holding members 22*b* are provided in the moving member 22*a* to hold the first closing member 3. The moving member 22*a* moves to the mold 1 (upward), and the holding members 22*b* holds the first closing member 3 in a lower position of the mold 1. In this holding state, the moving member 22*a* moves to the side opposite to the position when it close to the mold 1 (downward) to separate the first closing member 3 from the mold body 2.

Figure 5:
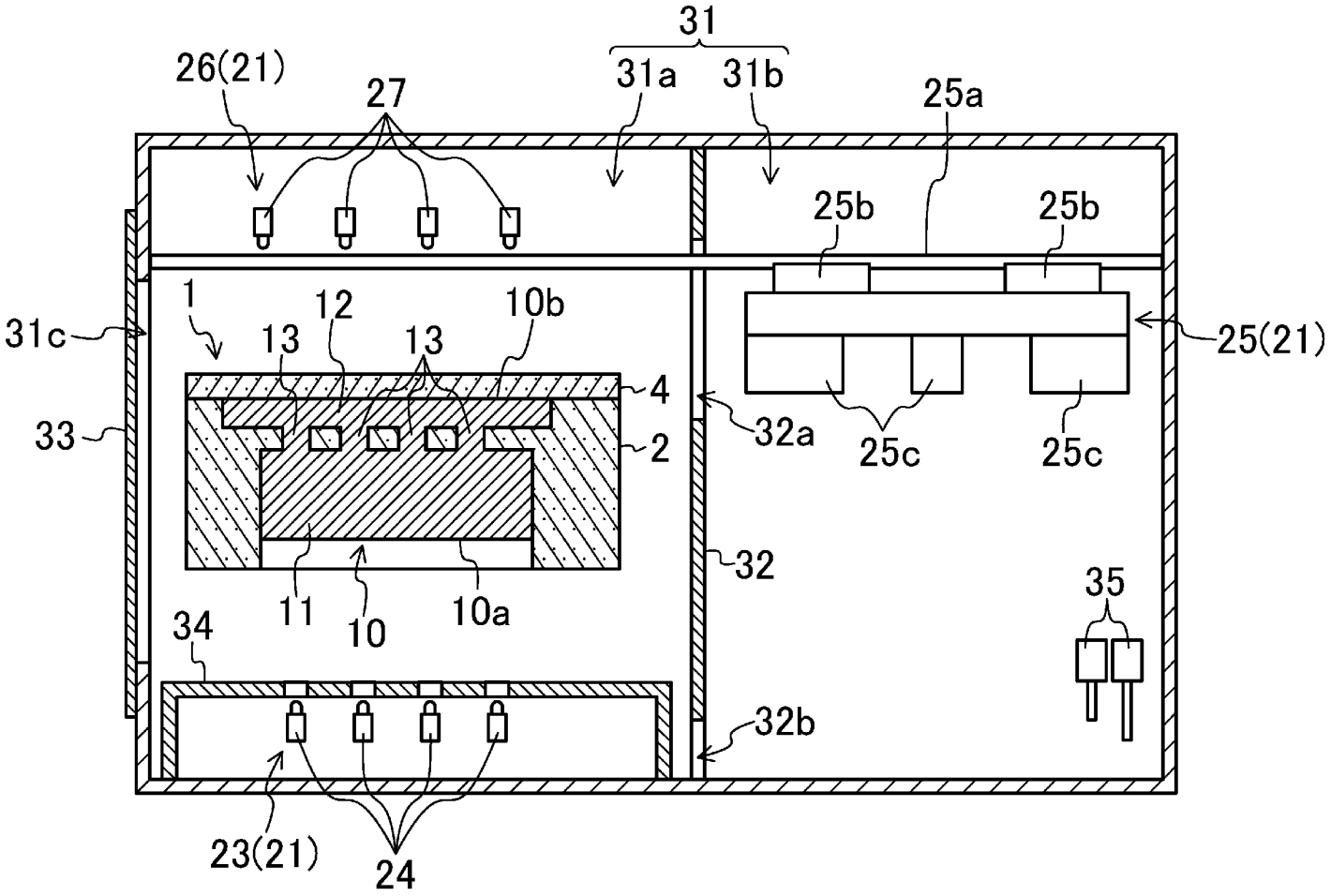
FIG. 5 is a cross-sectional view schematically illustrating the structure of a shower room.

As shown in FIG. 5, the cooling device (cooler) 21 includes a product side shower 23, a second closing member separator 25, and a feeder head side shower 26. The product side shower 23 showers the first surface 10*a* of the Al alloy casting 10, which has been exposed by the separation of the first closing member 3 by the first closing member separator 22, with mist of cooling liquid (cooling water in this embodiment) through a plurality of product side nozzles 24 facing the first surface 10*a* to quench and cool the Al alloy casting 10 (particularly, the product 11). After the start of the showering of the first surface 10*a* of the Al alloy casting 10 by the product side shower 23, the second closing member separator 25 separates the second closing member 4 of the mold from the mold body 2 to expose the second surface 10*b* of the Al alloy casting 10 through the second open portion 2*d* of the mold body 2. The feeder head side shower 26 showers the second surface 10*b* of the Al alloy casting 10, which has been exposed by the separation of the second closing member 4 by the second closing member separator 25, with mist of cooling liquid (cooling water in this embodiment) through feeder head side nozzles 27 facing the second surface 10*b*.

After the start and before the end of the showering of the first surface 10*a* of the Al alloy casting 10 by the product side shower 23, the feeder head side shower 26 starts showering the second surface 10*b* of the Al alloy casting 10 to quench and cool the Al alloy casting 10 (particularly, the product 11) together with the product side shower 23.

The product side shower 23, the second closing member separator 25, and the feeder head side shower 26 are provided in an almost airtight shower room 31. The shower room 31 is segmented into the chamber 31*a* and the second chamber 31*b*. A partition 32 is interposed between the chamber 31*a* and the second chamber 31*b*. The product side nozzles 24 of the product side shower 23 and the feeder head side nozzles 27 of the feeder head side shower 26 are provided in the chamber 31*a*. The chamber 31*a* includes a setting base (not shown) on which the mold 1 is placed, with the first closing member 3 separated from the mold body 2. A robotic system (not shown) is provided, which places the mold 1 onto the setting base from the outside of the shower room. In the mold 1, which has been placed on the setting base by the robotic system, the second closing member 4 is located above the mold body 2.

An opening 31*c* covered by an openable shutter 33 is formed in the wall of the chamber 31*a* of the shower room 31 opposite to the second chamber 31*b*. With the shutter 33 opened, the above-described mold 1 is placed on the setting base through the opening 31*c*. After the mold 1 has been placed on the setting base, the shutter 33 is closed to make the inside of the shower room 31 airtight. Part of the shutter 33 is a transparent member, through which the inside of the chamber 31*a* is observed from the outside of the shower room 31.

The second closing member separator 25 includes a rail 25*a*, moving members 25*b*, and holding members 25*c*. The rail 25*a* is substantially horizontally provided across the chamber 31*a* and the second chamber 31*b* in an upper portion in the shower room 31. The moving members 25*b* are driven by a driving device (not shown) to move along the rail 25*a* between the chamber 31*a* and the second chamber 31*b*. The holding members 25*c* are provided in the moving members 25*b*. When the moving members 25*b* are positioned in the chamber 31*a*, the holding members 25*c* vertically move to and away from the mold 1 placed on the setting base and hold the second closing member 4. These holding members 25*c* move to the mold 1 (downward) to hold the second closing member 4. In this holding state, the holding members 25*c* move to the side opposite to the position when it close to the mold 1 (upward) to separate the second closing member 4 from the mold body 2. After this separation, while the holding members 25*c* hold the second closing member 4, the moving members 25*b* (and the holding members 25*c*) move from the chamber 31*a* to the second chamber 31*b*. An opening 32*a* is formed in an upper portion of the partition 32. The moving members 25*b* and the holding members 25*c* holding the second closing member 4 pass through the opening 32*a*.

The second closing member separator 25 allows the second closing member 4, which has been separated from the mold body 2, to close the second open portion 2*d* of the mold body 2 again. Specifically, after the moving members 25*b* (and the holding members 25*c*) move from the second chamber 31*b* to the chamber 31*a*, the holding members 25*c* holding the second closing member 4 move downward to release the second closing member 4, thereby closing the second open portion 2*d* of the mold body 2 using the second closing member 4.

As shown in FIG. 6, the plurality of product side nozzles 24 of the product side shower 23 are arranged in three product side nozzle rows in a lower position of the mold 1, which has been placed on the setting base. The three product side nozzle rows are arranged at intervals along the width of the first surface 10*a* of the Al alloy casting 10 in the mold 1 to extend along the length of the first surface 10*a*. Three product side nozzles 24 are located in each of the end ones of the three product side nozzle rows. Four product side nozzles 24 are located in the other product side nozzle row (i.e., the middle product side nozzle row). The four product side nozzles 24 in the middle one of the three product side nozzle rows correspond to the four recesses 11*a* in the first surface 10*a* of the Al alloy casting 10. The three product side nozzles 24 in each of the end ones of the three product side nozzle rows are located between adjacent ones of the product side nozzles 24 of the middle product side nozzle row. The number of the product side nozzle rows are not limited to three. The number of the product side nozzles 24 in each row is not limited to three or four. The plurality of product side nozzles 24 are not necessarily arranged in rows. The product side nozzles 24 may be arranged such that almost the entire first surface 10*a* of the Al alloy casting 10 is showered.

The tops of the product side nozzles 24 are covered by a nozzle guard 34. This nozzle guard 34 prevents the cooling water from the product side nozzles 24 and the feeder head side nozzles 27 from falling on the product side nozzles 24.

Figure 7:
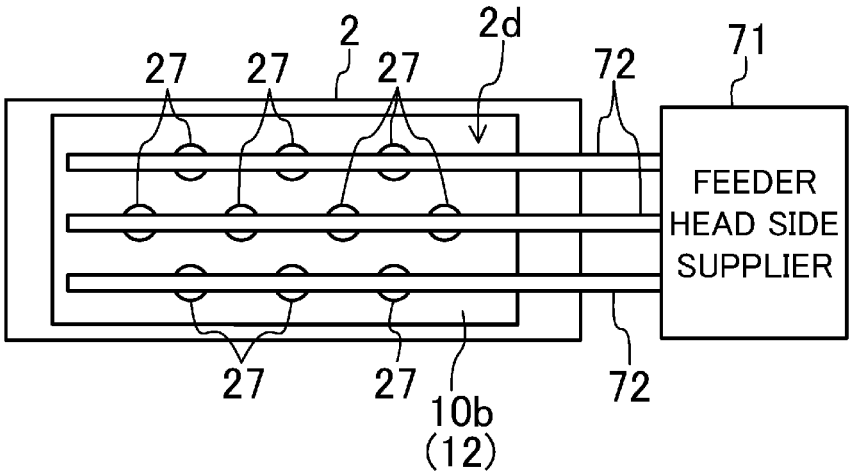
FIG. 7 illustrates a feeder head side shower.

As shown in FIG. 7, the plurality of feeder head side nozzles 27 of the feeder head side shower 26 are arranged in three feeder head side nozzle rows in an upper position of the mold 1, which has been placed on the setting base. The three feeder head side nozzle rows are arranged at intervals along the width of the second surface 10*b* of the Al alloy casting 10 in the mold 1 to extend along the length of the second surface 10*b*. Three feeder head side nozzles 27 are located in each of the end ones of the three feeder head side nozzle rows. Four feeder head side nozzles 27 are located in the other feeder head side nozzle row (i.e., the middle feeder head side nozzle row). The three feeder head side nozzles 27 in each of the end ones of the three feeder head side nozzle rows are located between adjacent ones of the feeder head side nozzles 27 of the middle feeder head side nozzle row. The number of the feeder head side nozzle rows are not limited to three. The number of the feeder head side nozzles 27 in each row is not limited to three or four. The plurality of feeder head side nozzles 27 are not necessarily arranged in rows. The feeder head side nozzles 27 may be arranged such that almost the entire second surface 10*b* of the Al alloy casting 10 is showered.

An opening 32*b* is formed at the lower end of the partition 32. The opening 32*b* allows the cooling water from the product side nozzles 24 and the feeder head side nozzles 27 (stored in a lower portion of the chamber 31*a*) to flow from the chamber 31*a* to the second chamber 31*b*. The cooling water flown to the second chamber 31*b* is discharged outside the shower room 31 from an outlet (not shown). The second chamber 31*b* includes an overflow detector 35 detecting that the water level in the second chamber 31*b* reaches a predetermined value. For example, when the outlet clogs, and the overflow detector 35 detects that the water level in the second chamber 31*b* reaches the predetermined value, the showering of the first surface 10*a* of the Al alloy casting 10 by the product side shower 23, and the showering of the second surface 10*b* of the Al alloy casting 10 by the feeder head side shower 26 are stopped.

Figure 8:
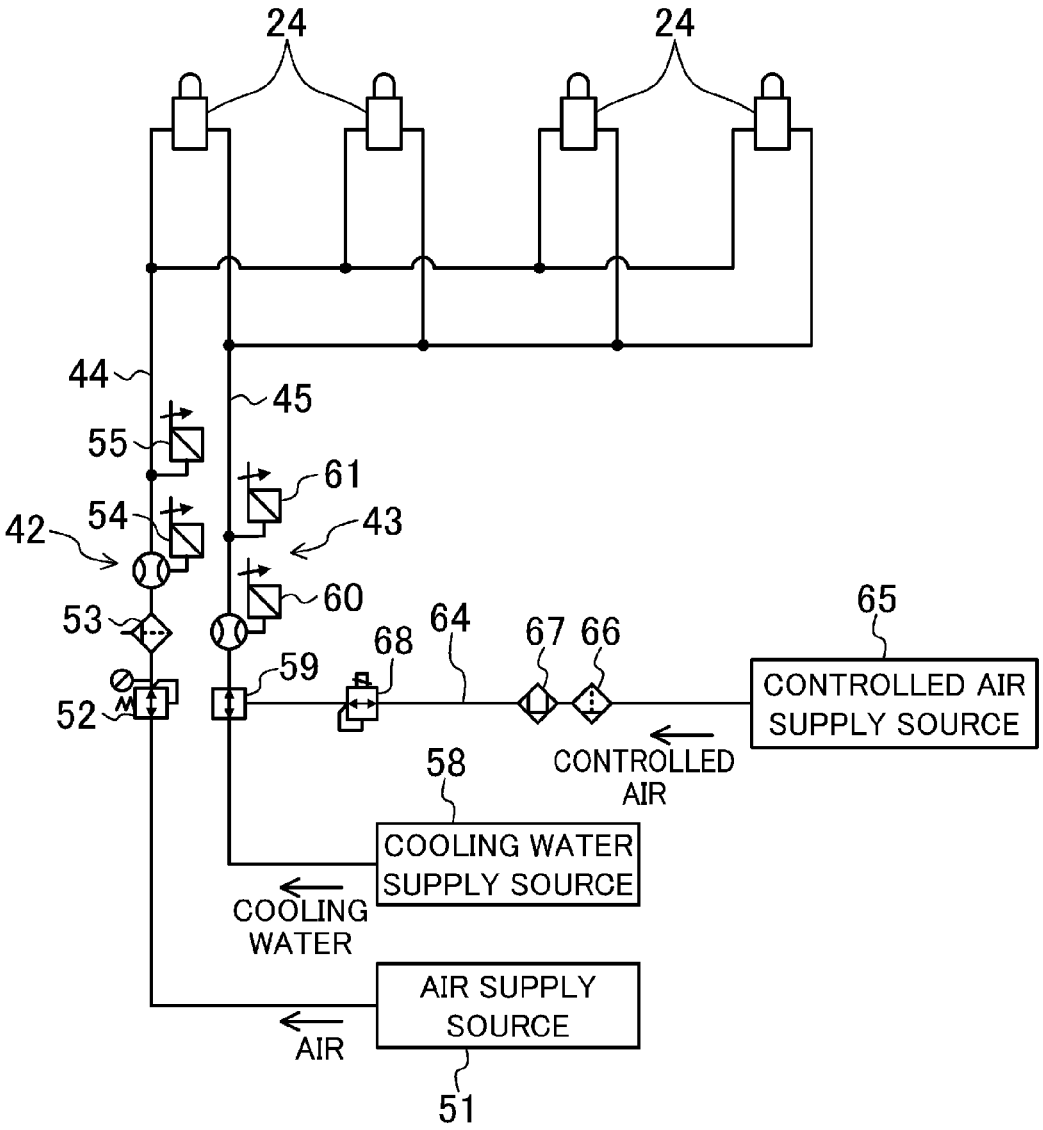
FIG. 8 illustrates the structures of an air supplier and a cooling water supplier in middle one of three product side nozzle rows.

The product side shower 23 includes a product side supplier 41 supplying air (compressed air) and the cooling water to the product side nozzles 24 while controlling the pressure of the air and the cooling water. The feeder head side shower 26 includes a feeder head side supplier 71 supplying air (compressed air) and the cooling water to the feeder head side nozzles 27 while controlling pressure of the air and the cooling water. In this embodiment, the same air pressure is applied to the product side nozzles 24 in a same product side nozzle row. The same cooling water pressure is applied to the product side nozzles 24 in a same product side nozzle row. The same air pressure is applied to the feeder head side nozzles 27 in a same feeder head side nozzle row. The same cooling water pressure is applied to the feeder head side nozzles 27 in a same feeder head side nozzle row. Thus, in the product side supplier 41, each product side nozzle row is provided with an air supplier 42 for supplying the air to the product side nozzles 24 and a cooling water supplier 43 for supplying the cooling water to the product side nozzles 24. The structures of the air supplier 42 and the cooling water supplier 43 are shown in FIG. 8 and will be described later in detail. FIG. 6 illustrates supply pipes 46 for the product side nozzle rows. Each supply pipe 46 includes an air supply passage 44 and a cooling water supply passage 45, which will be described later. In the feeder head side supplier 71, similar to the product side supplier 41, each feeder head side nozzle row is provided with an air supplier for supplying the air to the feeder head side nozzles 27 and a cooling water supplier for supplying the cooling water to the feeder head side nozzles 27. The air supplier and the cooling water supplier have structures similar to the air supplier 42 and the cooling water supplier 43, respectively, and detailed illustration is thus omitted. FIG. 7 illustrates supply pipes 72 similar to the supply pipes 46.

FIG. 8 illustrates the structures of the air supplier 42 and the cooling water supplier 43 in the middle one of the three product side nozzle rows. The air suppliers 42 and the cooling water suppliers 43 in the end ones of the three product side nozzle rows have the structure similar to the structures shown in FIG. 8. Only the number of the product side nozzles 24 is different.

Referring to FIG. 8, the air supplier 42 and the cooling water supplier 43 of the middle product side nozzle row will be described in detail.

The air supplier 42 includes the air supply passage 44 for supplying air (compressed air) to the product side nozzles 24 from an air supply source 51. The air supply passage 44 includes, in the order from upstream, an air pressure control regulator 52, a filter 53, an air flowmeter 54, and an air pressure sensor 55. The air pressure control regulator 52 controls the pressure of the air supplied to the product side nozzles 24. The filter 53 removes foreign substances from the air of the air supply passage 44. The air flowmeter 54 detects the flow rate of the air in the air supply passage 44. The air pressure sensor 55 detects the air pressure in the air supply passage 44. The air pressure control regulator 52 controls the pressure of the air supplied to the product side nozzles 24 based on the air pressure detected by the air pressure sensor 55.

The cooling water supplier 43 includes the cooling water supply passage 45 for supplying the cooling water to the product side nozzles 24 from a cooling water supply source 58. The cooling water supply passage 45 includes, in the order from upstream, a water pressure control regulator 59, a water flowmeter 60, and a water pressure sensor 61. The water pressure control regulator 59 controls the pressure of the cooling water supplied to the product side nozzles 24. The water flowmeter 60 detects the flow rate of the cooling water in the cooling water supply passage 45. The water pressure sensor 61 detects the cooling water pressure in the cooling water supply passage 45.

The water pressure control regulator 59 controls the pressure of the cooling water in the cooling water supply passage 45 by changing the controlled pressure of the air supplied to the water pressure control regulator 59. Thus, the water pressure control regulator 59 is connected to a controlled air supply passage 64 for supplying the controlled air to the water pressure control regulator 59 from a controlled air supply source 65. The controlled air supply passage 64 includes, in the order of upstream, a filter 66, a mist separator 67, and a pressure regulator 68. The filter 66 removes foreign substances from the controlled air. The mist separator 67 removes moisture from the controlled air. The pressure regulator 68 controls the pressure of the controlled air in the controlled air supply passage 64. The pressure regulator 68 controls the pressure of the controlled air supplied to the water pressure control regulator 59 based on the cooling water pressure detected by the water pressure sensor 61. Then, the water pressure control regulator 59 controls the cooling water pressure in the cooling water supply passage 45.

The product side supplier 41 sets the pressure of the cooling water supplied to the product side nozzles in the middle product side nozzle row higher than the pressure of the cooling water supplied to the product side nozzles 24 in the end ones of the three product side nozzle rows. Thus, even if the number of the product side nozzles 24 in the middle product side nozzle row is equal to the number of the product side nozzles 24 in the end product side nozzle rows, more cooling water is showered on the widthwise middle of the first surface 10*a* of the Al alloy casting 10 than on the both widthwise ends. In this embodiment, the number of the product side nozzles 24 in the middle product side nozzle row is larger than the number of the product side nozzles 24 in the end product side nozzle rows. Thus, further more cooling water is showered on the middle of the first surface 10*a* of the Al alloy casting 10 in the widthwise direction. Specifically, a widthwise intermediate portion of the product 11 of the Al alloy casting 10 is less likely to be cooled than the both widthwise ends, which are in contact with the mold body 2. The entire product 11 is thus uniformly cooled by showering more cooling water in the widthwise intermediate portion of the first surface 10*a*. Where there are four or more product side nozzle rows, as compared to the pressure of the cooling water supplied to the product side nozzles 24 in the product side nozzle rows located at the both ends, the pressure of the cooling water supplied to the product side nozzles 24 in the other product side nozzle rows may be set high.

The cooling water pressure of the three feeder head side nozzle rows is mainly determined by the positions of the connecting portions 13 (i.e., the feeder head supply passage 7). The pressure of the cooling water supplied to the feeder head side nozzles 27 in the middle feeder head side nozzle row is not necessarily higher than the pressure of the cooling water supplied to the feeder head side nozzles 27 in the feeder head side nozzle rows located at the ends.

Where the plurality of product side nozzles 24 are arranged in a row or not in a row, the air supplier 42 and the cooling water supplier 43 may be provided in each product side nozzle 24 (so do the air supplier and the cooling water supplier of the feeder head side supplier 71). Alternatively, similar to the air supplier 42 and the cooling water supplier 43 for the product side nozzles 24 in the same row, the air supplier 42 and the cooling water supplier 43 for the product side nozzles 24, which have the same air pressure and the same cooling water pressure, may be formed in common (so may the air supplier and the cooling water supplier of the feeder head side supplier 71).

The particle size of the mist of the cooling water coming out of the product side nozzles 24 and the feeder head side nozzles 27 preferably ranges from 30 nm to 50 nm. Specifically, where the particle size of the mist of the cooling water is smaller than 30 nm, the mist of the cooling water is likely to be vaporized in the air, and the mist of the cooling water may be vaporized before touching the first surface 10*a* or the second surface 10*b* of the Al alloy casting 10. On the other hand, where the particle size is greater than 50 nm, it may take a long time to vaporize the mist of the cooling water after touching the first surface 10*a* or the second surface 10*b* of the Al alloy casting 10. Thus, the particle size falls within the range from 30 nm to 50 nm, thereby allowing the mist of the cooling water to touch the first surface 10*a* or the second surface 10*b* of the Al alloy casting 10 and vaporizing the mist of the cooling water immediately after the touch. As a result, the Al alloy casting 10 is efficiently cooled.

The particle size of the mist of the cooling water coming out of the product side nozzles 24 is readily controlled by controlling the pressure of the air and the cooling water supplied to the product side nozzles 24. Similarly, the particle size of the mist of the cooling water coming out of the feeder head side nozzles 27 is readily controlled by controlling pressure of the air and the cooling water supplied to the feeder head side nozzles 27.

After the end of the showering of the first surface 10*a* of the Al alloy casting 10 by the product side shower 23 and showering the second surface 10*b* of the Al alloy casting 10 by the feeder head side shower 26, the cooling device (cooler) 21 brings the second closing member 4 back to the state closing the second open portion 2*d* of the mold body 2 using the second closing member separator 25. As a result, the Al alloy casting 10 (particularly, the product 11) is aged with the residual heat of the Al alloy casting 10. In order to perform the aging with the residual heat, the temperature of the surface of the product 11 at the feeder head 12 is set higher than the temperature of the surface (the first surface 10*a*) of the product 11 opposite to the feeder head 12 by a predetermined temperature (e.g., 150° C.-200° C.) at the end of the showering of the first surface 10*a* of the Al alloy casting 10 by the product side shower 23 and showering the second surface 10*b* of the Al alloy casting 10 by the feeder head side shower 26. For the purpose, the showering of the first surface 10*a* of the Al alloy casting 10 by the product side shower 23 is basically started first. After the start and before the end of the showering, the showering of the second surface 10*b* of the Al alloy casting 10 by the feeder head side shower 27 is started. In this embodiment, the showering of the first surface 10*a* and the showering of the second surface

10*b* end at the same time. The timing is not limited thereto. At the end of the showering of the first surface 10*a* and showering the second surface 10*b*, the temperature of the surface of the product 11 at the feeder head 12 may be higher than the temperature of the surface (the first surface 10*a*) of the product 11 opposite to the feeder head 12 by the predetermined temperature.

Next, a method of cooling the Al alloy casting 10 formed in the above-described mold 1 using the cooling device (cooler) 21 will be described.

As shown in FIG. 4, after the Al alloy casting 10 has been formed, the first closing member separator 22 separates the first closing member 3 of the mold 1 from the mold body 2 to expose the first surface 10*a* of the Al alloy casting 10 through the first open portion 2*c* of the mold body 2.

After that, the robotic system places the mold 1, with the first closing member 3 separated from the mold body 2, on the setting base in the shower room 31 from the outside of the shower room 31. Then, the shutter 33 is closed to make the inside of the shower room 31 almost airtight.

Figure 12:
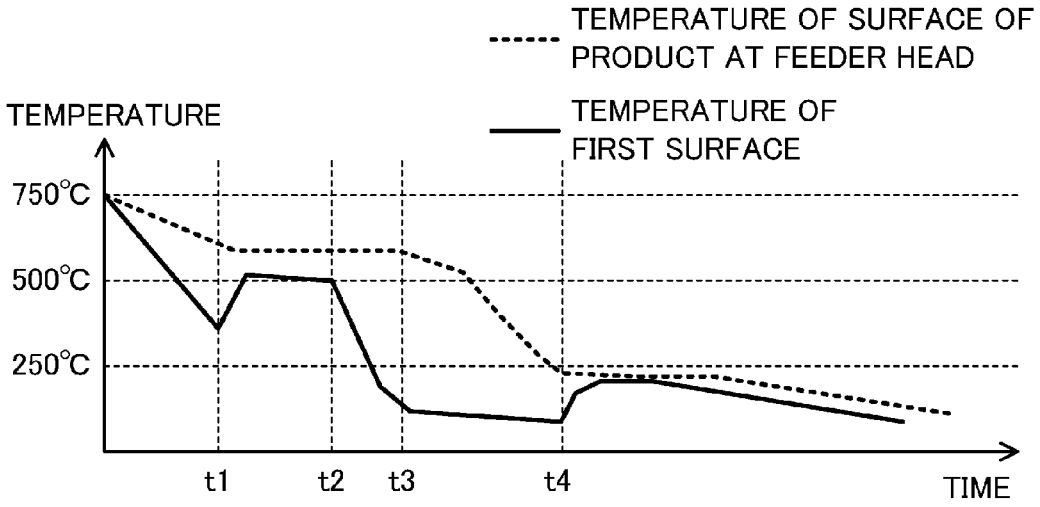
FIG. 12 is a graph illustrating a measurement result of changes in the temperature of the center of the surface (the first surface) of the product (i.e., the cylinder head) of the Al alloy casting opposite to the feeder head, and the temperature of the center of the surface of the product at the feeder head.

After the mold 1, with the first closing member 3 separated from the mold body 2, is placed on the setting base, wait a predetermined time after the first closing member 3 of the mold 1 has been separated from the mold body 2. The predetermined time is set to control the temperature of the first surface 10*a* at the start of the showering of the first surface 10*a* of the Al alloy casting 10 by the product side shower 23 (i.e., the cooling start temperature of the Al alloy casting 10) to the temperature (e.g., 500° C.) suitable for quenching the product 11 of the Al alloy casting 10. Specifically, since the first closing member 3 is the metal mold, the molten Al alloy 9 is deprived of the heat by the first closing member 3 when the molten Al alloy 9 is solidified. As a result, at the end of forming the Al alloy casting 10, the temperature at the portion of the product 11 opposite to the feeder head 12 (including the first surface 10*a*) becomes lower than the suitable temperature (see FIG. 12). On the other hand, at the end of forming the Al alloy casting 10, the temperature of the feeder head 12 or the portion of the product 11 at the feeder head 12 is higher than the suitable temperature. When the first closing member 3 is separated from the mold body 2 (at a time t1 of FIG. 12), less heat is radiated from the first surface 10*a*. Then, when the heat of the feeder head 12 or the portion of the product 11 at the feeder head 12 is conducted to the side of the product 11 opposite to the feeder head 12, the temperature of the side of the product of the Al alloy casting opposite to the feeder head (including the first surface) becomes the suitable temperature. FIG. 12 is a graph illustrating a measurement result of changes in the temperature of the center of the surface (the first surface 10*a*) of the above-described product (cylinder head) 11 opposite to the feeder head 12 and in the temperature of the center of the surface of the product 11 at the feeder head 12.

Figure 9:
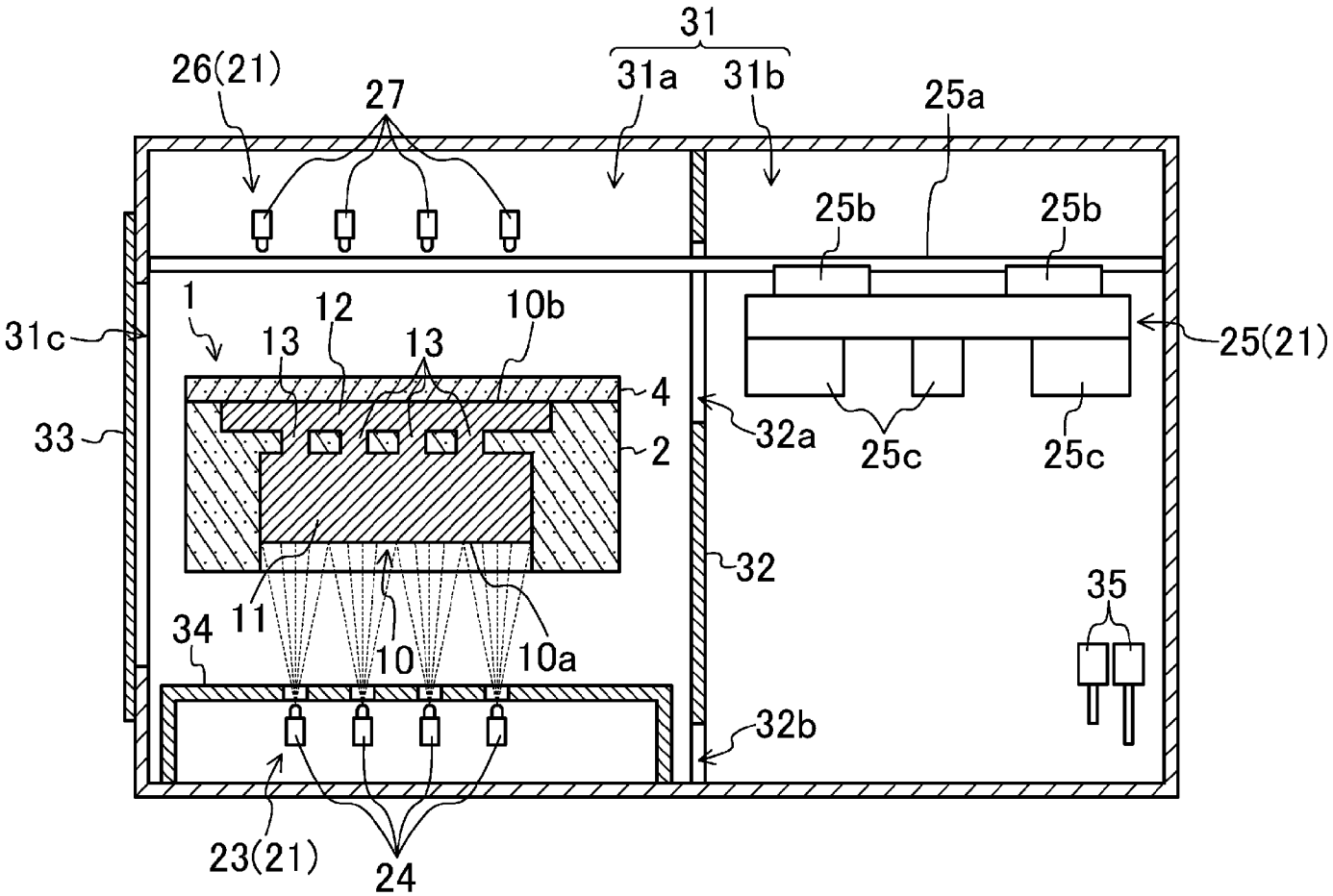
FIG. 9 is a schematic view illustrating that a first surface of the Al alloy casting is showered with mist of cooling water through product side nozzles.

After a predetermined time has passed after separation of the first closing member 3 from the mold body 2 (at a time t2 of FIG. 12), the product side shower 23 operates to shower the first surface 10*a* of the Al alloy casting 10 with the mist of the cooling liquid through the product side nozzles 24 as shown in FIG. 9. This quenches and cools the Al alloy casting 10. This showering of the first surface 10*a* rapidly cools the side of the product 11 opposite to the feeder head 12 including the first surface 10*a* (see FIG. 12).

After the start of the showering of the first surface 10*a*, the second closing member separator 25 separates the second closing member 4 from the mold body 2 to expose the second surface 10*b* of the Al alloy casting 10 through the second open portion 2*d* of the mold body 2. The second closing member 4 is separated from the mold body 2 before the start of the showering of the second surface 10*b* of the Al alloy casting 10, which is performed after the separation.

Figure 10:
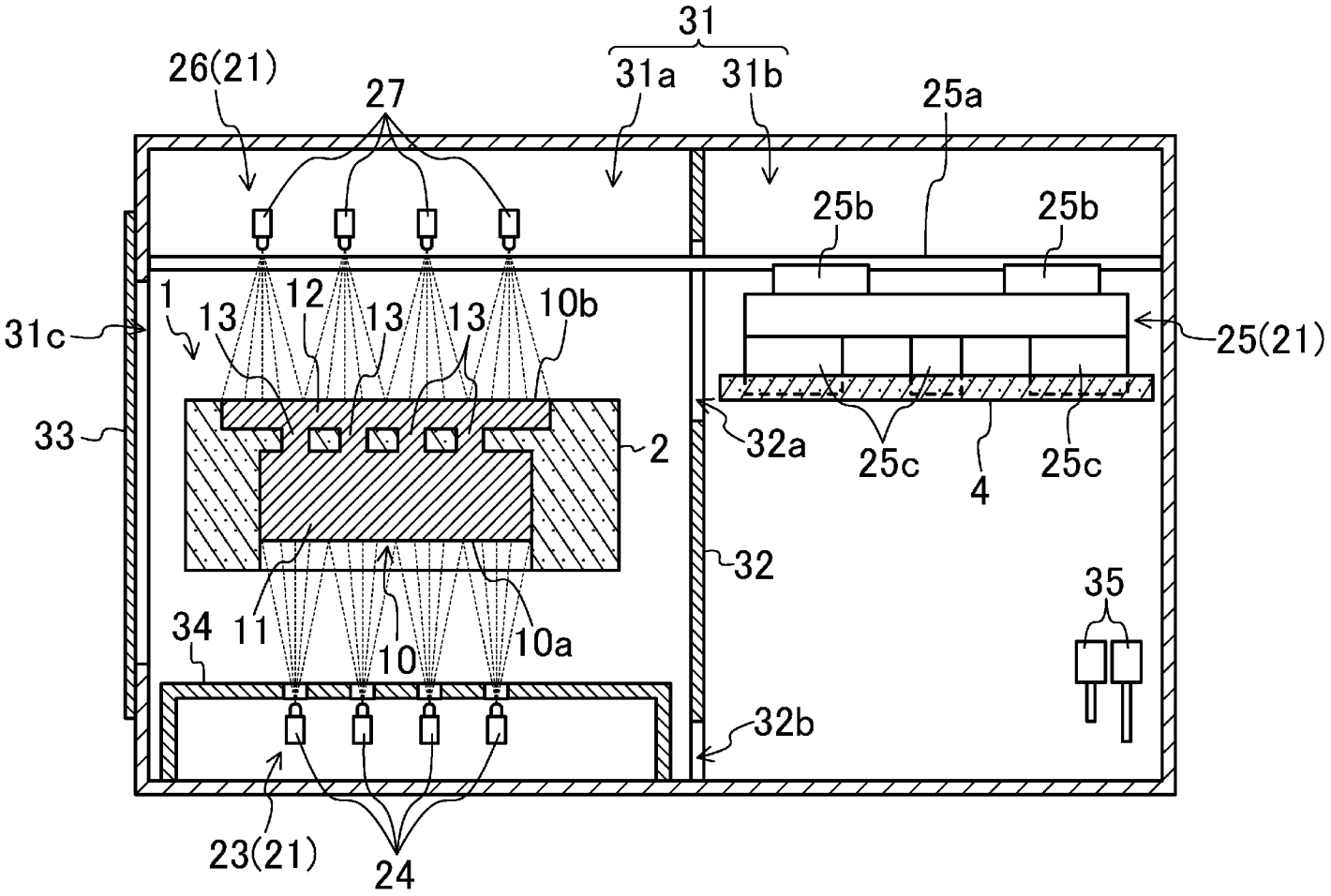
FIG. 10 is a schematic view illustrating that the first surface of the Al alloy casting is showered with mist of cooling water through the product side nozzles, and that the second surface is showered with mist of cooling water through feeder head side nozzles.

Then, as shown in FIG. 10, the feeder head side shower 26 operates to shower the second surface 10*b* of the Al alloy casting 10, which has been exposed by the separation of the second closing member 4, with mist of cooling liquid through the feeder head side nozzles 27. The showering of the second surface 10*b* starts after the start and before the end of the showering of the first surface 10*a*. Specifically, the showering of the second surface 10*b* preferably starts at the time (a time t3 of FIG. 12) when the rapidly dropping temperature of the portion of the product 11 opposite to the feeder head 12 is switched to an almost stable state by the showering of the first surface 10*a* (the temperature drop rate is switched from the rate higher than a first predetermined rate to the rate lower than a second predetermined rate, which is the first predetermined rate). As such, the showering of the second surface 10*b* quenches and cools the Al alloy casting 10 (particularly, the product 11) together with the showering of the first surface 10*a*.

The showering of the first surface 10*a* cools the product 11 of the Al alloy casting 10 from the surface (the first surface 10*a*) opposite to the feeder head 12 toward the feeder head 12. The feeder head 12 side of the product 11 is less likely to be cooled than the side of the product 11 opposite to the feeder head 12 by the showering of the first surface 10*a* only due to the heat of the feeder head 12. As a result, the temperature of the product 11 hardly becomes uniform between the side opposite to the feeder head 12 and the feeder head 12 side. However, in this embodiment, the showering of the second surface 10*b* greatly cools the feeder head 12 side of the product 11 via the feeder head 12. This results in reduction in variations in the strength of the whole product 11 of the Al alloy casting 10, and less deformation of the product 11, thereby reducing differences in the size among a plurality of portions (particularly, the four recesses 11*a*) of the product 11, which need to have the same size.

After a first predetermined time has passed after the start of the showering of the second surface 10*b* (at a time t4 of FIG. 12), the showering of the first surface 10*a* and the showering of the second surface 10*b* end at the same time. For the first predetermined time, the temperature of the surface of the product 11 at the feeder head 12 becomes higher than the temperature of the first surface 10*a* by the predetermined temperature.

Figure 11:
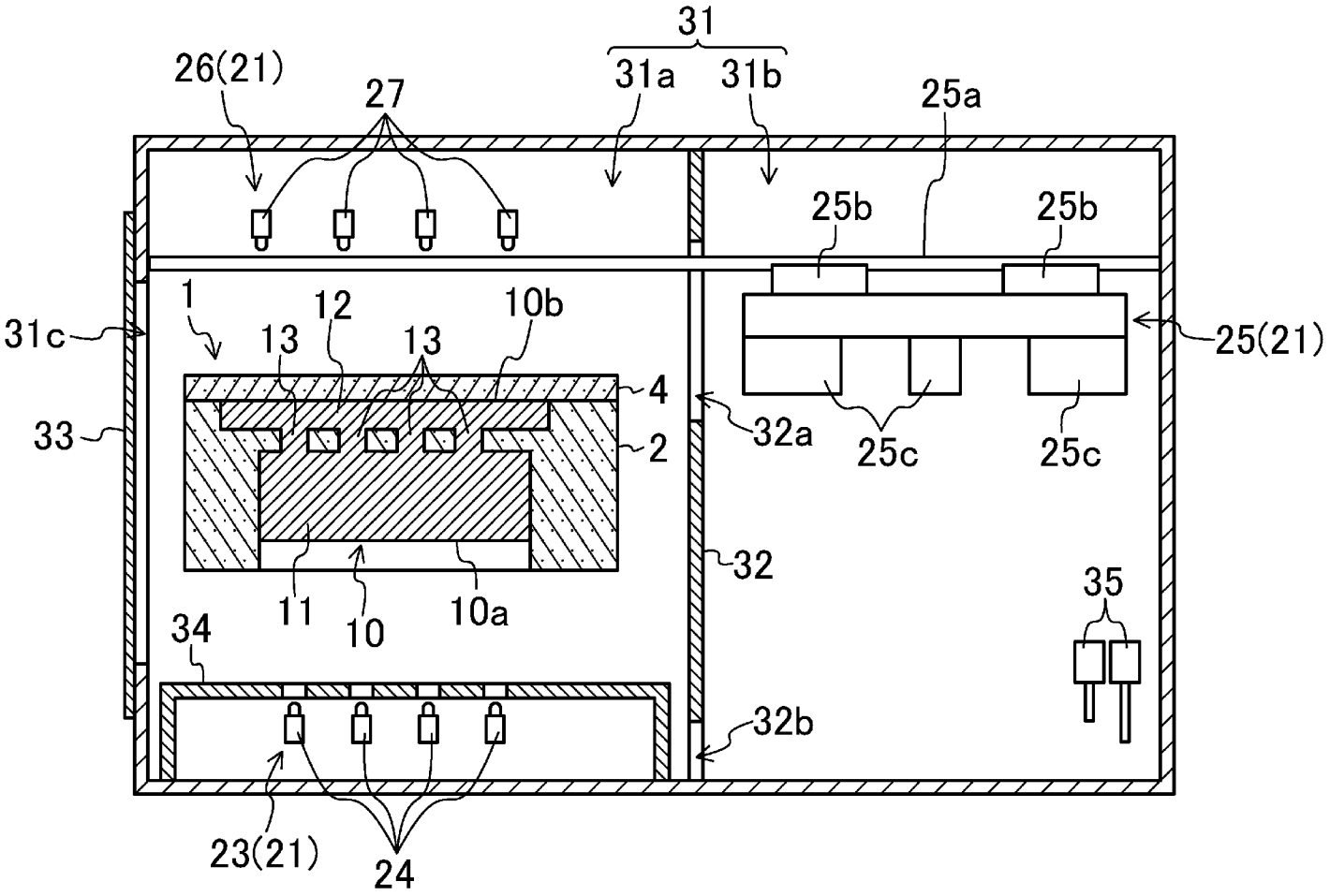
FIG. 11 is a schematic view illustrating that a second open portion is closed by a second closing member in aging the Al alloy casting.

After the end of the showering of the first surface 10*a* and the second surface 10*b*, the second closing member separator 25 immediately operates to bring the second closing member 4 to the state of closing the second open portion 2*d* of the mold body 2 (see FIG. 11). After that, the shutter 33 of the shower room 31 is opened. Then, the robotic system extracts outside the shower room 31, the mold body 2 whose second open portion 2*d* is closed by the second closing member 4.

Next, the closing state of the above-described second open portion 2*d* is continued for a second predetermined time to age the Al alloy casting 10 (the product 11). Where the second open portion 2*d* of the mold body 2 is closed by the second closing member 4, the residual heat at the feeder head 12 or the feeder head 12 side of the product 11 is not released outside the mold body 2 and greatly conducted to the side of the product 11 opposite to the feeder head 12. As a result, the temperature of the side of the product 11 opposite to the feeder head 12 rises so that the temperature of the whole Al alloy casting 10 (particularly, the whole product 11) becomes substantially uniform (see the time t4 and later in FIG. 12). In this state, the whole Al alloy casting 10 (the whole product 11) is substantially uniformly aged. Thus, variations in the strength of the aged entire product 11 of the Al alloy casting 10 are further reduced. Differences in the size among the plurality of portions of the product (particularly, the four recesses 11*a*), which need to have the same size, are further reduced.

In the aging, even if the first open portion 2*c* of the mold body 2 is open, less heat is radiated from the first surface 10*a* of the Al alloy casting 10. The residual heat at the feeder head 12 or the feeder head 12 side of the product 11 is conducted to the portion of the product 11 opposite to the feeder head 12. This properly ages the Al alloy casting 10 (the product 11). In particular, as in this embodiment, where the first closing member 3 is the metal mold and the first open portion 2*c* of the mold body 2 is closed by the first closing member 3 again, the heat conducted to the side of the product 11 opposite to the feeder head 12 tends to be released to the first closing member 3. In addition, the first closing member 3 being the metal mold is likely to be thermally deformed, thereby not reliably closing the first open portion 2*c*. In view of the problems, the first open portion 2*c* of the mold body 2 is preferably open. By using the sand mold for the mold body 2 and the second closing member 4, the Al alloy casting 10 greatly insulates heat, thereby performing excellent aging.

After the end of the aging, the mold body 2 and the second closing member 4, which are the sand mold, are broken to extract the Al alloy casting 10. After the sand attached to the Al alloy casting 10 is removed, the feeder head 12 and the connecting portions 13 are separated from the product 11. At the end, the product 11 is finished (deburred, etc.).

Therefore, in this embodiment, variations in the strength of the entire product 11 of the Al alloy casting 10 are reduced, and the product 11 is less deformed, thereby further reducing differences in the size among the plurality of portions (particularly, the four recesses 11*a*) of the product 11, which need to have the same size. In addition, there is no need to heat the quenched and cooled Al alloy casting 10 in a furnace, etc. to age the Al alloy casting 10. The Al alloy casting is thus readily aged.

The present invention is not limited to the above-described embodiment. Variations and modifications are made within the scope of the claimed subject matter.

In the above-described embodiment, while an example has been described where the product 11 of the Al alloy casting 10 is the cylinder head, the product 11 is not limited thereto. The product 11 may be, for example, cylinder blocks and the other Al alloys.

The above-described embodiment is a mere example. The scope of the present invention should not be construed as limiting. The scope of the present invention is defined by the claims of the present invention. The present invention includes all variations and modifications within the scope of the claims and the equivalents.

In a cylinder head (hereinafter referred to as Sample 1) obtained in a manner similar to the above-described embodiment, the hardness (specifically, Brinell hardness (which is also used in the following examples)) of the portions (i.e., the recesses) of the surface at the combustion chamber was measured, which correspond to the first to the fourth cylinders. For comparison, a cylinder head (hereinafter referred to as Sample 2) cooled by sinking in stored water, the mold whose first closing member was separated from the mold body after the casting. The hardness of the portions of the surface at the combustion chamber was measured, which correspond to the first to the third cylinders. The sample 2 was sunk in water to be quenched, and then aged in a furnace. The sample 2 was casted in a mold similar to that in the sample 1.

Figure 13:
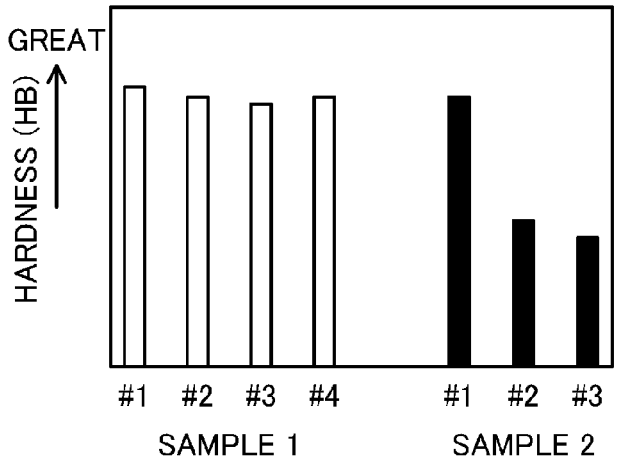
FIG. 13 is a graph illustrating a measurement result of the hardness of the portions of the surface of a sample 1 at a combustion chamber, which correspond to the first to the fourth cylinders, and the hardness of the portions of the surface of a sample 2 at the combustion chamber, which correspond to the first to the third cylinders.

FIG. 13 illustrates the measurement result. In FIG. 13, #1-#4 denote the portions of the surface of the sample 1 at the combustion chamber, which correspond to the first to the fourth cylinders, and #1-#3 denote the portions of the surface of the sample 2 at the combustion chamber, which correspond to the first to the third cylinders. The sample 1 has small variations in the hardness among the portions of the surface at the combustion chamber, which correspond to the four cylinders. That is, there are small variations in the strength.

Figure 14:
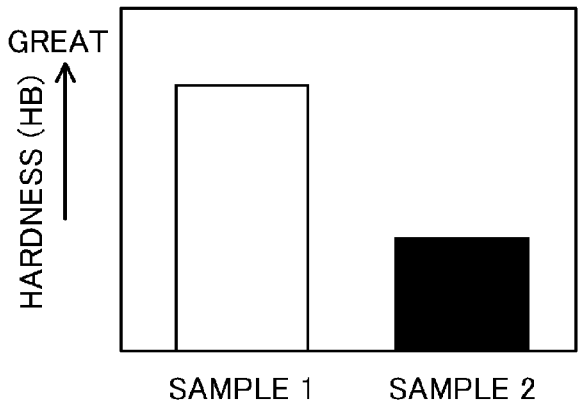
FIG. 14 is a graph illustrating a result of the hardness in the center of the surface of each of the sample 1 and the sample 2 at the head cover.

Then, the hardness in the center of the surface of each of the samples 1 and 2 at the head cover was measured. FIG. 14 illustrates the measurement result. In the sample 1, the hardness of the surface at the head cover is almost the same as the hardness of the surface at the combustion chamber. Therefore, the sample 1 as a whole has small variations in the strength. On the other hand, in the sample 2, when sunk in water, the head cover side does not touch the water. Thus, the sample 2 is insufficiently quenched and has low hardness. Even if only the surface at the combustion chamber is showered, a result similar to the sample 2 is assumed to be obtained, unless the surface at the head cover is showered.

Figure 15:
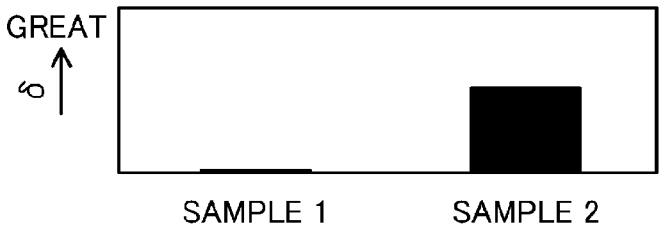
FIG. 15 is a graph illustrating the difference between the maximum value and the minimum value of the measured values of the maximum depths of the four recesses of the surface of the sample 1 at the combustion chamber, and the difference between the maximum value and the minimum value of the measured values of the maximum depths of the four recesses of the surface of the sample 1 at the combustion chamber

Next, the maximum depth of each of the four recesses in the sample 1 was measured. The difference δ between the maximum value and the minimum value of the measured maximum depths of the four recesses was obtained. For comparison, the difference δ between the maximum value and the minimum value of the measured maximum depths of the four recesses in the sample 2 was obtained. FIG. 15 illustrates the result. In the sample 1, the difference δ is significantly small, which shows that the differences in the size among the plurality of recesses are significantly small.

Then, the temperature of the first surface (the quenching start temperature of the first surface) at the start of the showering of the first surface of the Al alloy casting by the product side shower was changed. At each quenching start temperature, the tensile strength and the proof stress of the side (the first surface side) of the product of the Al alloy casting opposite to the feeder head after the showering were obtained. The product here is a cylinder head similar to that in the above-described embodiment.

Figure 16:
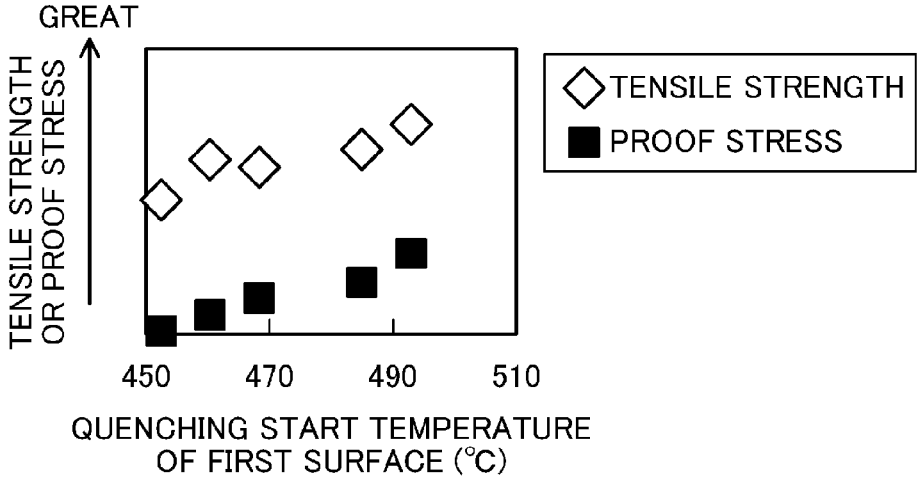
FIG. 16 is a graph illustrating the relation between the temperature of the first surface (i.e., the quenching start temperature of the first surface) of the product side shower at the start of the showering of the first surface of the Al alloy casting, and the tensile strength and the proof stress of the side of the product of the Al alloy casting opposite to the feeder head after the showering.

FIG. 16 illustrates the relation between the quenching start temperature of the first surface and the tensile strength and the proof stress of the side of the product opposite to the feeder head. As a result, when the quenching start temperature of the first surface falls within the range from 480° C. to 500° C., desired strength of the cylinder head is reliably obtained.

INDUSTRIAL APPLICABILITY

The present invention is useful for a method of cooling an Al alloy casting formed by injecting a molten Al alloy into a cavity and a feeder head cavity formed in a mold, and a device for cooling such an Al alloy casting.

DESCRIPTION OF REFERENCE CHARACTERS

1 Mold
2 Mold Body
2*a* First Space
2*b* Second Space
2*c* First Open Portion

2*d* Second Open Portion
3 First Closing Member
4 Second Closing Member
5 Cavity
6 Feeder Head Cavity
9 Molten Al Alloy
10 Al Alloy Casting
11 Product
12 Feeder Head
21 Cooling Device (Cooler)
22 First Closing Member Separator
23 Product Side Shower
24 Product Side Nozzle
25 Second Closing Member Separator
26 Feeder Head Side Shower
27 Feeder Head Side Nozzle
31 Shower Room
41 Product Side Supplier
71 Feeder Head Side Supplier

The invention claimed is:

1. A method of cooling an Al alloy casting formed by injecting a molten Al alloy into a cavity and a feeder head cavity formed in a mold, and including a product corresponding to the cavity and a feeder head corresponding to the feeder head cavity, the mold including a mold body including a first space for the cavity, a second space for the feeder head cavity, a first opening that exposes the first space toward a side opposite to the second space, and a opening that exposes the second space toward a side opposite to the first space, a first closing body that closes the first opening of the mold body to form the cavity together with the mold body, and a second closing body that closes the second opening of the mold body to form the feeder head cavity together with the mold body, the method comprising:

after forming the Al alloy casting in the mold, separating the first closing body of the mold from the mold body to expose a first surface of the Al alloy casting being a surface of the product opposite to the feeder head through the first opening of the mold body;

product side showering by showering the first surface of the Al alloy casting exposed in the separating the first closing body with mist of cooling liquid through a product side nozzle facing the first surface to quench and cool the Al alloy casting;

after a start of the product side showering, separating the second closing body of the mold from the mold body to expose a second surface of the Al alloy being a surface of the feeder head opposite to the product through the second opening of the mold body; and feeder head side showering by showering the second surface of the Al alloy casting exposed in the separating the second closing body with mist of cooling liquid through a feeder head side nozzle facing the second surface, wherein the feeder head side showering starts showering the second surface of the Al alloy casting after the start and before an end of the product side showering to quench and cool the Al alloy casting together with the product side showering.

2. The method of cooling the Al alloy casting of claim 1, further comprising:

after the end of the product side showering and the feeder head side showering, aging the Al alloy casting with residual heat of the Al alloy casting with the second opening of the mold body closed again by the second closing body of the mold.

3. The method of cooling the Al alloy casting of claim 1, wherein the product side nozzle includes a plurality of product side nozzles, the feeder head side nozzle includes a plurality of feeder head side nozzles, the product side showering showers the first surface of the Al alloy casting with the mist of the cooling liquid through the product side nozzles while controlling pressure of air and the cooling liquid supplied to the product side nozzles, and the feeder head side showering showers the second surface of the Al alloy casting with the mist of the cooling liquid through the feeder head side nozzles, while controlling pressure of air and the cooling liquid supplied to the feeder head side nozzles.

4. The method of cooling the Al alloy casting of claim 3, wherein each of the first and second surfaces of the Al alloy casting is in a substantially rectangular shape, the plurality of product side nozzles are arranged at intervals along a width of the first surface of the Al alloy casting in at least three product side nozzle rows extending along a length of the first surface, the plurality of feeder head side nozzles are arranged at intervals along a width of the second surface of the Al alloy casting in at least three feeder head side nozzle rows extending along a length of the second surface, and as compared to pressure of the cooling liquid supplied to the product side nozzles in end ones of the at least three product side nozzle rows, pressure of the cooling liquid supplied to the product side nozzles in the other product side nozzle row(s) is set high.

5. The method of cooling the Al alloy casting of claim 1, wherein a particle size of the mist of the cooling liquid supplied from the product side nozzle and the feeder head side nozzle ranges from 30 μm to 50 μm, both inclusive.

6. The method of cooling the Al alloy casting of claim 1, wherein the product side showering, the separating the second closing body, and the feeder head side showering are performed in a shower room.

7. The method of cooling the Al alloy casting of claim 1, wherein the product of the Al alloy casting is a cylinder head of an engine, and the first surface of the Al alloy casting is a surface of the cylinder head at a combustion chamber.

* * * * *